US009555464B2

(12) United States Patent
Samko et al.

(10) Patent No.: US 9,555,464 B2
(45) Date of Patent: Jan. 31, 2017

(54) TENSION EXPANSION CLAMPING TOOL BLOCK

(71) Applicant: Carrier Corporation, Farmington, CT (US)

(72) Inventors: Michael W. Samko, Collierville, TN (US); William E. Moyt, Memphis, TN (US); Larry Pugh, Rossville, TN (US)

(73) Assignee: CARRIER CORPORATION, Farmington, CT (US)

( * ) Notice: Subject to any disclaimer, the term of this patent is extended or adjusted under 35 U.S.C. 154(b) by 688 days.

(21) Appl. No.: 13/866,191

(22) Filed: Apr. 19, 2013

(65) Prior Publication Data

US 2013/0340255 A1 Dec. 26, 2013

Related U.S. Application Data

(60) Provisional application No. 61/662,421, filed on Jun. 21, 2012.

(51) Int. Cl.

| | |
|---|---|
| ***B21D 53/02*** | (2006.01) |
| ***B21D 41/02*** | (2006.01) |
| ***B21D 53/08*** | (2006.01) |
| *B21D 39/20* | (2006.01) |

(52) U.S. Cl.

CPC ..... *B21D 53/02* (2013.01); *B21D 41/026* (2013.01); *B21D 53/085* (2013.01); *B21D 39/20* (2013.01); *Y10T 29/49391* (2015.01); *Y10T 29/53122* (2015.01)

(58) Field of Classification Search

CPC ..... B21D 39/08; B21D 39/20; B21D 41/02; B21D 41/026; B21D 53/02; B21D 53/06; B21D 53/08; B21D 53/085; B21D 9/05; Y10T 29/49391; Y10T 29/53122

See application file for complete search history.

(56) References Cited

U.S. PATENT DOCUMENTS

| | | | | |
|---|---|---|---|---|
| 1,791,887 | A * | 2/1931 | Davies | B21D 41/025 72/318 |
| 4,134,287 | A | 1/1979 | Le Huede et al. | |
| 4,459,917 | A | 7/1984 | Michael et al. | |
| 4,584,751 | A | 4/1986 | Gray et al. | |
| 4,584,765 | A | 4/1986 | Gray | |
| 4,720,902 | A | 1/1988 | Gray | |
| 4,745,678 | A * | 5/1988 | Gray | B21C 37/24 29/523 |
| 4,761,866 | A * | 8/1988 | Murphy | B21D 41/02 29/406 |
| 4,815,185 | A | 3/1989 | Gray | |

(Continued)

*Primary Examiner* — Edward Tolan
(74) *Attorney, Agent, or Firm* — Cantor Colburn LLP

(57) ABSTRACT

An apparatus for expanding and belling a tube is provided including a receiver for supporting a first end of the tube. A stripper block assembly orients a second end of the tube along an axis. The stripper block assembly includes a first grip and a second grip movable in and out of engagement with a surface of the tube. The apparatus also includes a movable belling tool axially aligned with the tube. The belling tool bells a desired length of the tube and supports the second end of the tube. An expander tool is arranged to pass through the axially aligned tube to expand the tube. The expander tool includes an expander rod and an expander bullet. A portion of the expander bullet has a diameter larger than the diameter of the tube.

8 Claims, 8 Drawing Sheets

(56) References Cited

U.S. PATENT DOCUMENTS

| | | | | | |
|---|---|---|---|---|---|
| 4,835,828 | A * | 6/1989 | York | B21D 53/085 29/727 |
| 4,843,860 | A | 7/1989 | Gray | |
| 4,850,101 | A | 7/1989 | McDonough et al. | |
| 4,858,296 | A | 8/1989 | Gray | |
| 4,858,305 | A | 8/1989 | Gray et al. | |
| 4,876,779 | A | 10/1989 | Gray | |
| 5,070,608 | A | 12/1991 | Gray | |
| 5,127,155 | A * | 7/1992 | Kendic | B21D 53/085 29/523 |
| 5,404,942 | A | 4/1995 | Patel | |
| 5,815,913 | A | 10/1998 | Tokura | |
| 7,650,772 | B2 | 1/2010 | Minor | |
| 8,276,261 | B2 * | 10/2012 | Baba | B21D 39/06 29/270 |
| 2010/0263202 | A1 | 10/2010 | Baba | |

* cited by examiner

TENSION EXPANSION CLAMPING TOOL BLOCK

CROSS REFERENCE TO RELATED APPLICATIONS

This application claims the benefit of U.S. Provisional Patent Application Ser. No. 61/662,421 filed Jun. 21, 2012, the entire contents of which are incorporated herein by reference thereto.

BACKGROUND OF THE INVENTION

Embodiments relate generally to heat exchanger coils and, more particularly, to a method and apparatus for expanding and belling heat exchanger coils having aluminum or copper tubes.

Plate-fin type heat exchangers are commonly employed in air conditioning and refrigeration systems. A plate-fin heat exchanger coil is commonly constructed with a plurality of flat, parallel plates having laterally spaced holes for receiving refrigerant tubes, or hairpin tubes therein. At each end of the plate-fin bundle, there is a tube sheet composed of heavier material, and adjacent one of the tube sheets, the open ends of the hairpin tubes are fluidly connected with a U-shaped return bend secured thereto by way of soldering, brazing, or the like. When the coils are installed into a refrigeration system, the refrigerant flows through the hairpin tubes, and the air to be cooled or heated passes over the plate-fins, causing heat transfer to occur.

Though compression expansion is a commonly used when manufacturing heat exchanger coils, such a process has known complications. The conventional compression expansion process generally includes passing tube expanding rods through the open ends of the hairpin tubes and then belling the tube. A backing plate is placed against the tube bends to prevent the tubes from being driven out of the unit as the expanding tools are forced therethrough. As a result of this holding action, the tubes are compressed rearwardly as they are expanded outwardly by the tools. This, in turn, causes the tubes to shrink so that the axial length of each tube can vary dramatically. Because of the differences in tube length, belling of the tubes is difficult and generally results in uneven or misaligned bells being formed in the tube ends. The bell ends can also be uneven, which makes automatic brazing or soldering difficult.

BRIEF DESCRIPTION OF THE INVENTION

According to one embodiment of the invention, an apparatus for expanding and belling a tube is provided including a receiver for supporting a first end of the tube. A stripper block assembly orients a second end of the tube along an axis. The stripper block assembly includes a first grip and a second grip movable in and out of engagement with a surface of the tube. The apparatus also includes a movable belling tool axially aligned with the tube. The belling tool bells a desired length of the tube and supports the second end of the tube. An expander tool is arranged to pass through the axially aligned tube to expand the tube. The expander tool includes an expander rod and an expander bullet. A portion of the expander bullet has a diameter larger than the diameter of the tube.

According to another aspect of the invention, a method is provided for tension expanding and belling a tube including mounting a first end of the tube in a receiver. The second end of the tube is then oriented with a stripper block assembly along an axis. The stripper block assembly includes a first grip and a second grip movable between a first position and a second position. The first grip and the second grip are moved into the second position. A portion of the tube adjacent the second end is expanded using an expander tool. A bell is then formed at the second end of the tube with a first portion of the belling tool. The first grip and the second grip are moved out of the second position so that the expander tool may be advanced to the first end of the tube.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION OF THE INVENTION

Figure 2:
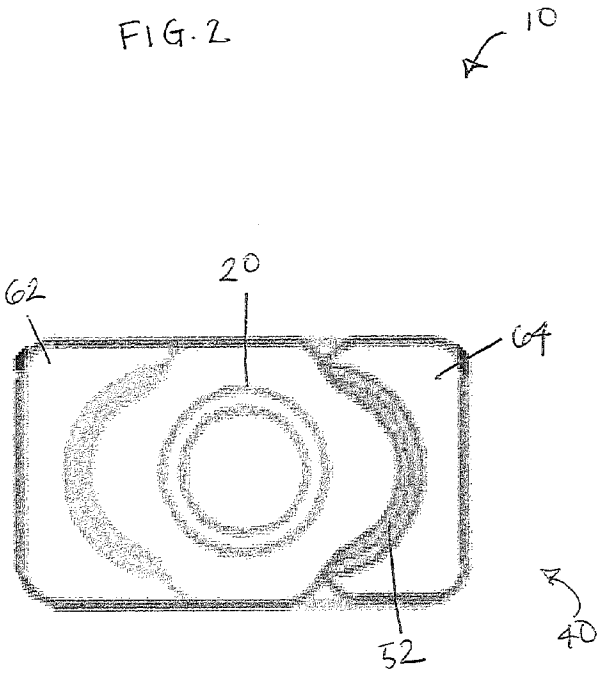
FIG. 2 is a top view of a tube expanding apparatus according to an embodiment of the invention.

Referring to the FIGS., a portion of a tube expanding apparatus 10 is shown for belling and expanding an open end 22 of a tube 20, such as a hairpin tube in a plate-fin type heat exchanger for example. Multiple hairpin tubes may be laced into a stack 32 of aligned fin plates and a tube sheet (not shown) to hold the assembly in place. The apparatus 10 is arranged to expand one or more tubes at a time. In one embodiment, the tubes 20 may be arranged in a plurality of rows having multiple tubes per row, where some or all of the rows are active at a time. In some heat exchanger coils, the open ends 22 of the tubes 20 are provided with an offset or standoff between the tube sheet and the bells in which return bends (not shown) are soldered or brazed.

The tube expanding apparatus 10 includes a receiver (not shown), such as a pair of mating dies for example, for securing the U-shaped end (not shown) of a tube 20. In one embodiment, the receiver includes a groove (not shown) complementary to the U-shaped end, within which the tube 20 fits. The tube expanding apparatus 10 additionally includes a stripper block assembly 40 that surrounds a portion of the tube 20 between the U-shaped end and the open end 22. The base of the stripper block assembly 40 includes a stripper plate 42 having a central bore 44. In one embodiment, the diameter of the central bore 44 is larger than the diameter of a belled open end 22 of the tube 20 so that the stripper plate 42 may be slidably removed from around the tube 20 after the expansion process is completed.

The stripper block assembly 40 also includes a first grip plate 50 and a second grip plate 60 adjacent the stripper plate 42. In one embodiment, the first grip plate 50 and the second grip plate 60 are identical. The first grip plate 50 includes a movable first grip 52 and a first block 54 positioned on opposite sides of a first hole 56. The second grip plate 60 also includes a movable second grip 62 and a second block 64 disposed on opposite sides of a second hole 66. The first grip plate 50 and the second grip plate 60 are stacked such that the first grip 52 is adjacent the second block 64 and the second grip 62 is adjacent the first block 54. In one embodiment, the first grip plate 50 and the second grip plate 60 face one another in the stripper block assembly 40. When stacked, the first hole 56 and the second hole 66 are coaxial with the bore 44 of the stripper plate 42 along an axis A.

Figure 1:
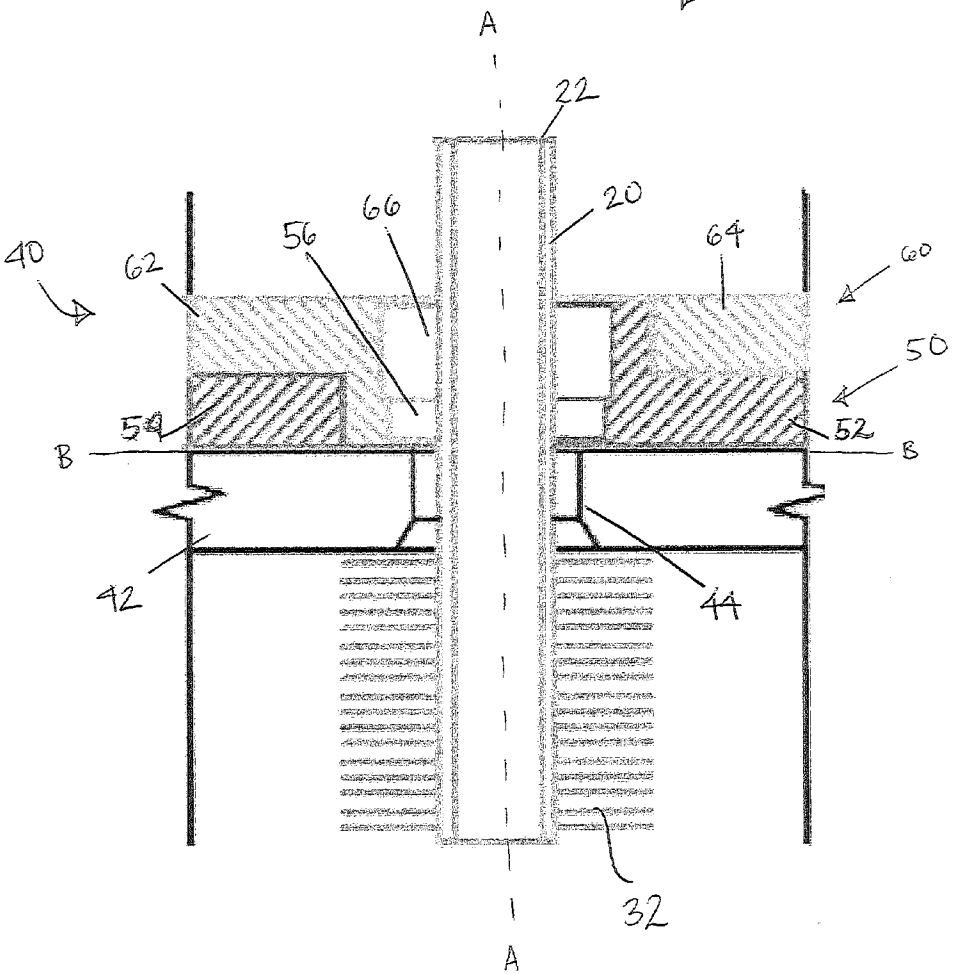
FIG. 1 is a cross-sectional view of a tube expanding apparatus according to an exemplary embodiment of the invention.

The first grip 52 and the second grip 62 are movable along a plane B perpendicular to axis A and parallel to a surface of the first and second grip plates 50, 60. The first grip 52 and the second grip 62 generally move between a first position (see FIG. 1) and a second position (see FIG. 3), in a direction indicated by arrows F and G. In the first position, a portion of the first grip plate 52 abuts the second block 64 and a portion of the second grip plate 62 abuts the first block 54, such that the first and second block 54, 64 limit the movement of the first grip 52 and second grip 62 in a direction away from the tube 20. In one embodiment, the first grip 52 and the second grip 62 are generally L-shaped.

The tube expanding apparatus 10 additionally includes a belling tool 70 (FIG. 5) and an expander tool 80 (FIG. 4) centrally located about and movable along axis A, in the direction of the stripper block assembly 40, indicated by arrow K. The belling tool 70 includes a generally hollow shaft 72 having a first portion 74 with a first diameter and a second, adjacent portion 76 with a second diameter. In one embodiment, the diameter of the second portion 76 is greater than the diameter of the first portion 74 to limit movement of the belling tool 70 relative to the tube 20 in the direction indicated by arrow K. The expander tool 80 includes an expander rod 82 located within the hollow shaft 72 of the belling tool 70. A generally conical expander bullet 84 is connected to an end of the expander rod 82. The expander bullet 84 has a diameter larger than the diameter of the rod 82 and the inner diameter of a tube 20. The diameter of the expander bullet 84 is smaller than the outer diameter of the first portion 74 of the belling tool 70 (see FIG. 5). In addition, the expander tool 80 and the belling tool 70 may be moved independently of each other.

Figure 3:
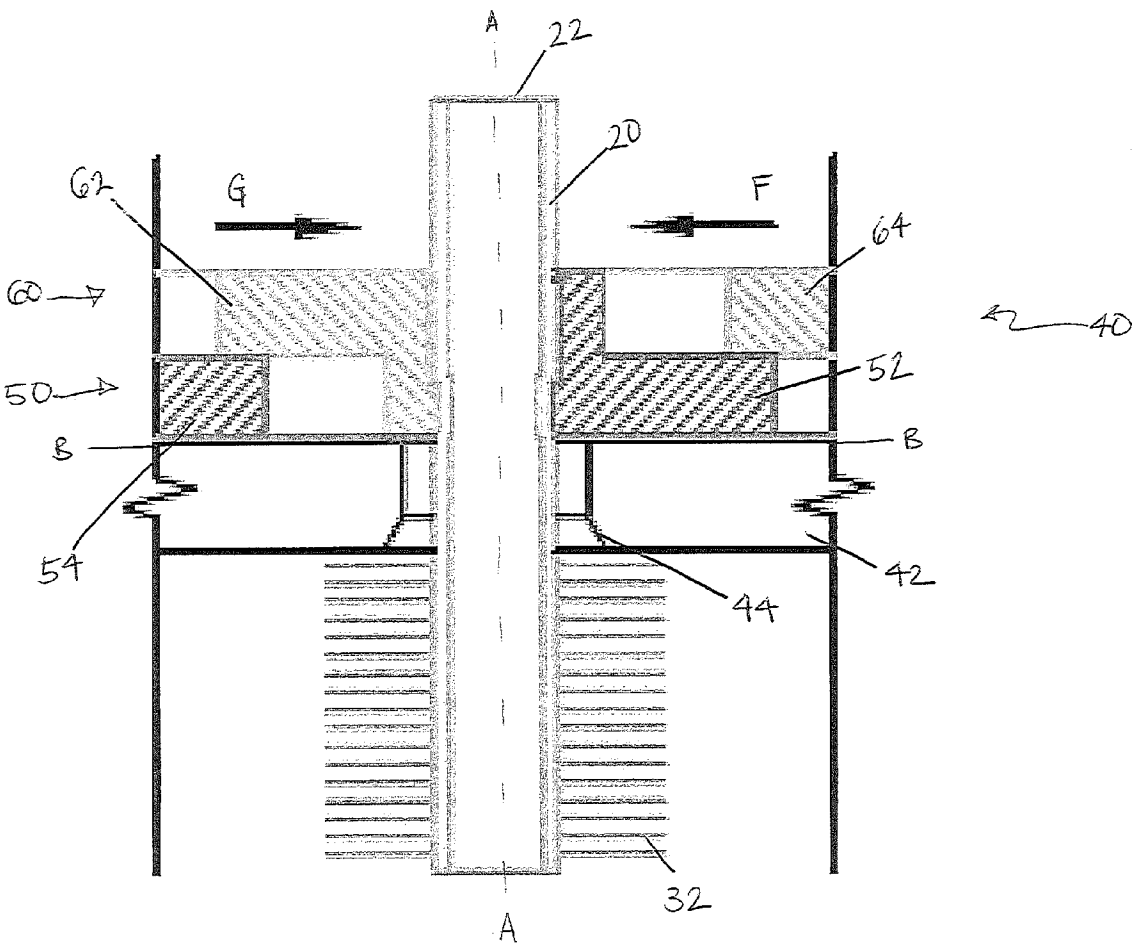
FIG. 3 is a cross-sectional view of a tube expanding apparatus according to an exemplary embodiment of the invention.

Referring again to FIG. 1, when the tube 20 is mounted in the tube expanding apparatus 10, the U-shaped bend is held in place within the grooves of the receiver (not shown). To orient and stabilize the open end 22 of the tube 20, the stripper block assembly 40 is installed by inserting the open end 22 of the tube 20 through the holes 56, 66 of the first and second gripper plates 50, 60 and the bore 44 of the stripper plate 42. As illustrated in FIG. 3, once the stripper block assembly 40 is located in position along the length of the tube 20, the first grip 52 and the second grip 62 are moved into a second position, wherein each grip 52, 62 engages an opposite surface of the tube 20. In the second position, the first grip 52 and the second grip 62 apply a force to the tube 20.

Figure 4:
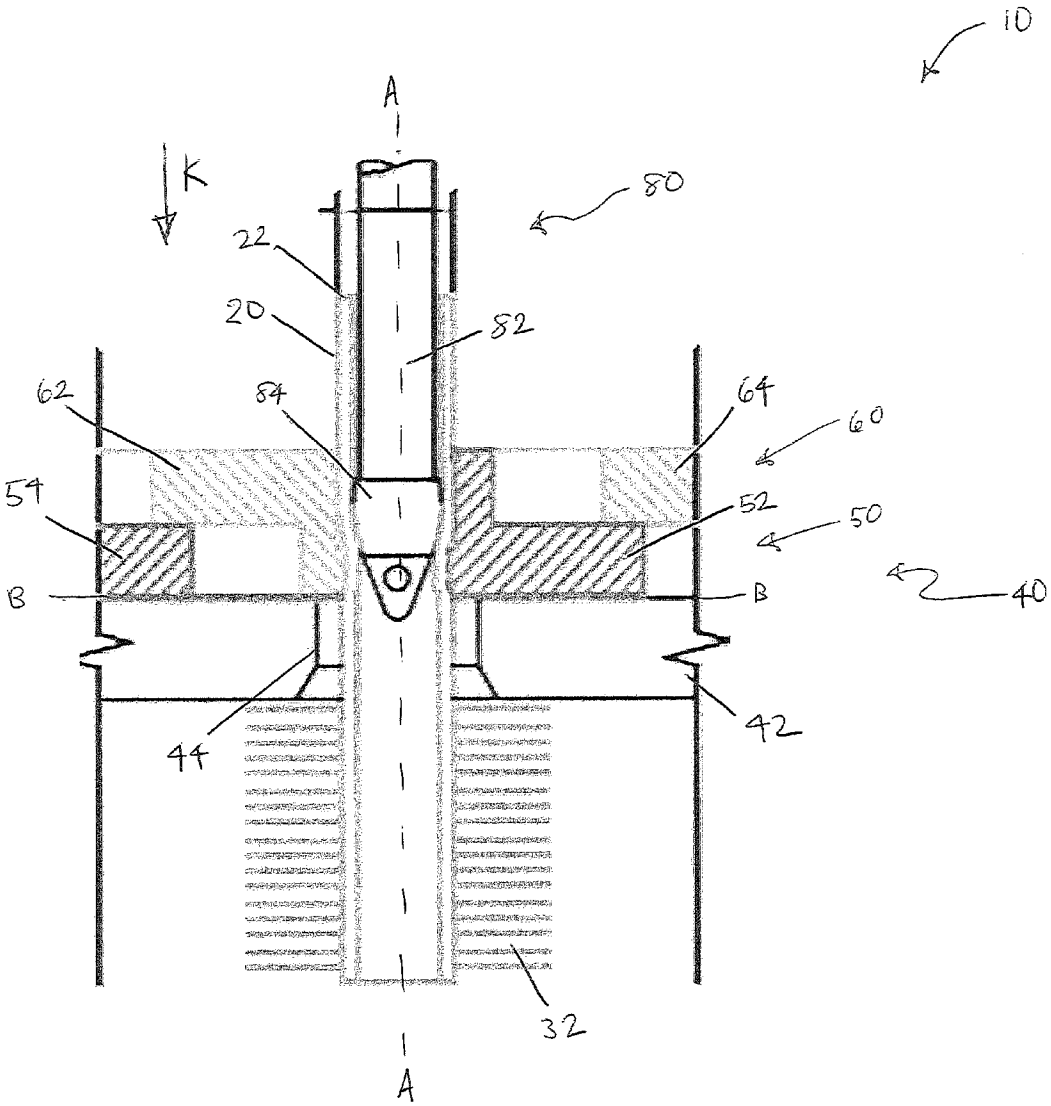
FIG. 4 is a cross-sectional view of a tube expanding apparatus according to an exemplary embodiment of the invention.
Figure 5:
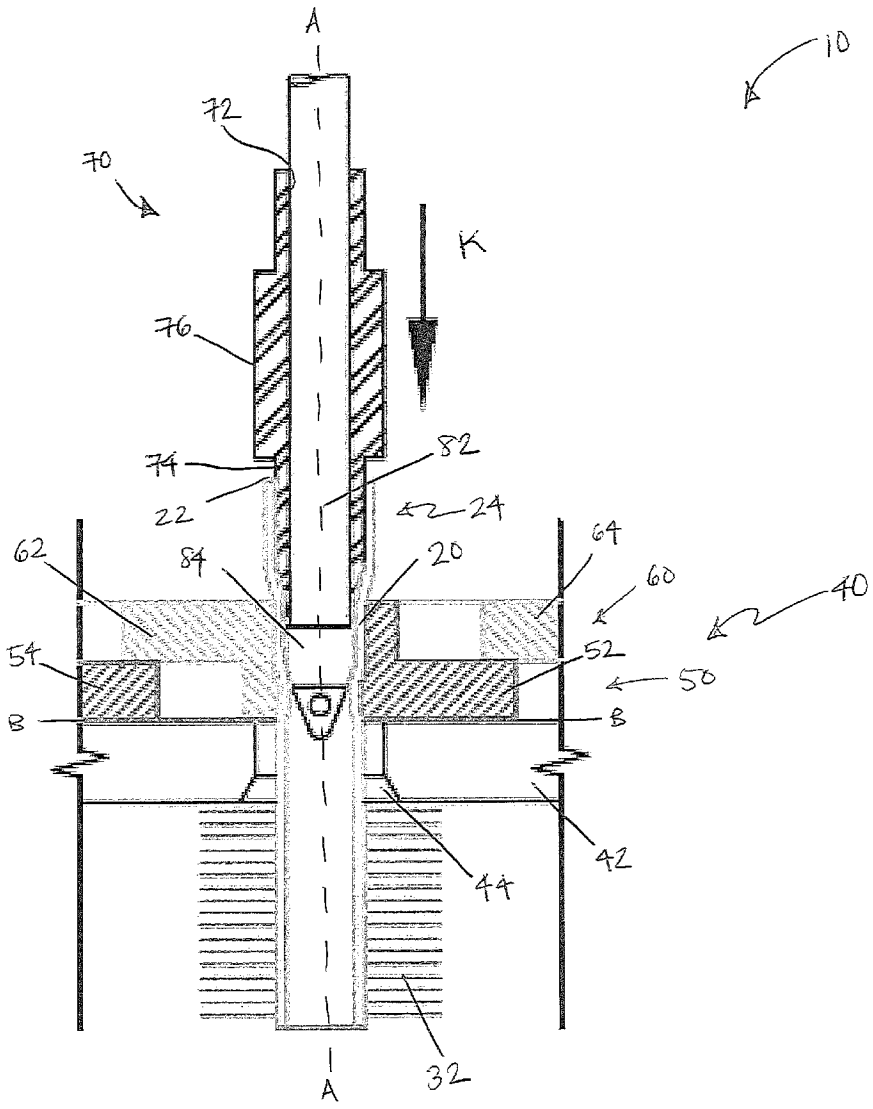
FIG. 5 is a cross-sectional view of a tube expanding apparatus according to an exemplary embodiment of the invention.

Referring now to FIG. 4, the expander bullet 84 of the expander tool 80 is inserted into the open end 22 of the tube 20. In one embodiment, the expander bullet 84 travels through a portion of the tube 20 and stops at the interface between the first grip plate 50 and the stripper plate 42. In the second position, the first and second grip 52, 62 apply a force to the tube 20 such that further movement of the expander bullet 84 is restricted. Inserting the expander bullet 84 of the expander tool 80 into the open end 22 of the tube 20, causes the inner diameter of the portion of the tube 20 through which the expander bullet 84 passes to expand to a diameter generally equal to the diameter of the expander bullet 84. The first portion 74 of the belling tool 70 is then inserted into the open end 22 of the tube 20, as shown in FIG. 5. The expander tool 80 need not be retracted before inserting the belling tool 70 into the tube 20. In one embodiment, the first portion 74 of the belling tool 70 is inserted into the open end 22 of the tube 20 until it reaches an edge of the stripper block assembly 40. The belling tool 70 causes the inner diameter of a portion of the open end 22 of the tube 20 to expand to a diameter generally equal to the outer diameter of the first portion 74 which is larger than the expander bullet 84 of the expander tool 80. Insertion of the first portion 74 of the belling tool 70 creates a bell 24 at the end 22 of the tube 20 adjacent the stripper block assembly 40. Once inserted, the first portion 74 of the belling tool 70 remains within the tube 20.

Figure 6:
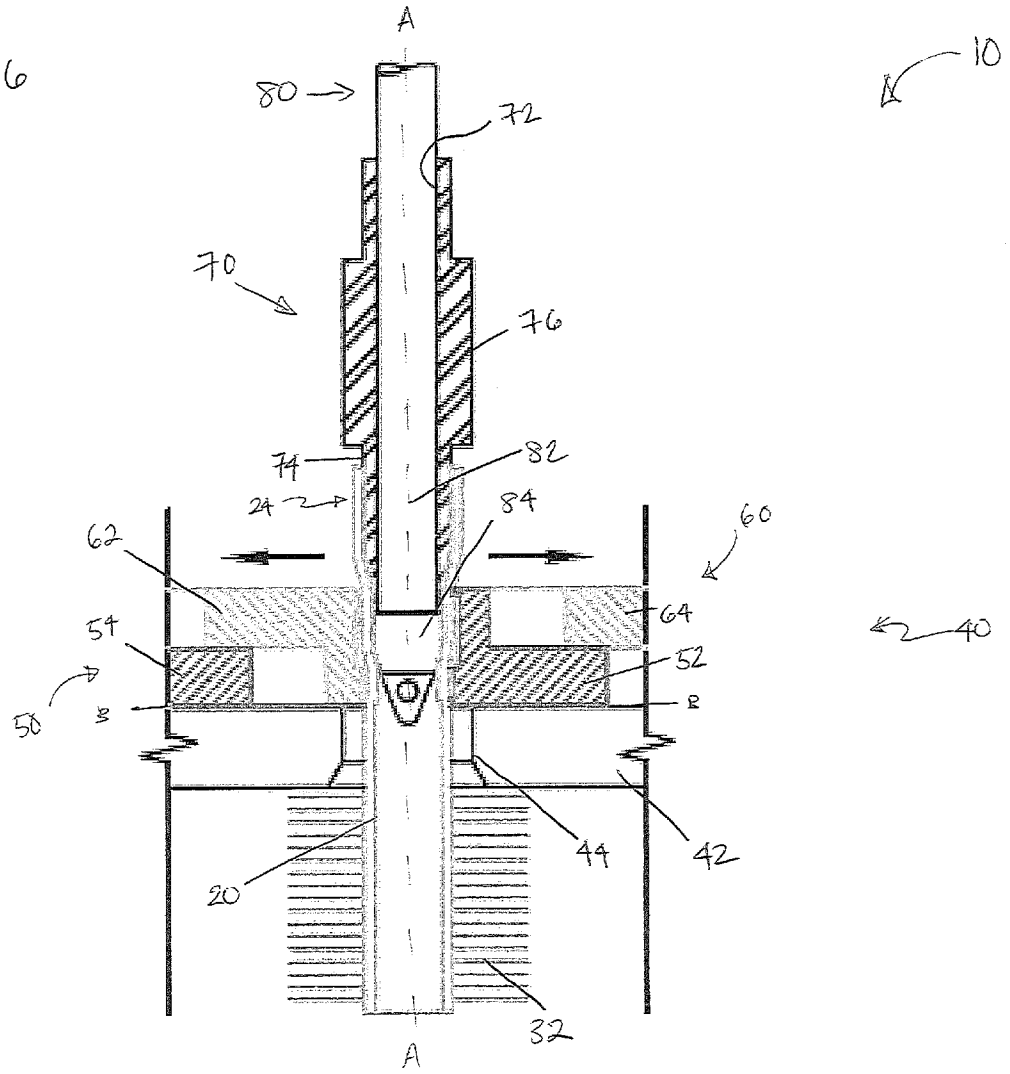
FIG. 6 is a cross-sectional view of a tube expanding apparatus according to an exemplary embodiment of the invention.
Figure 7:
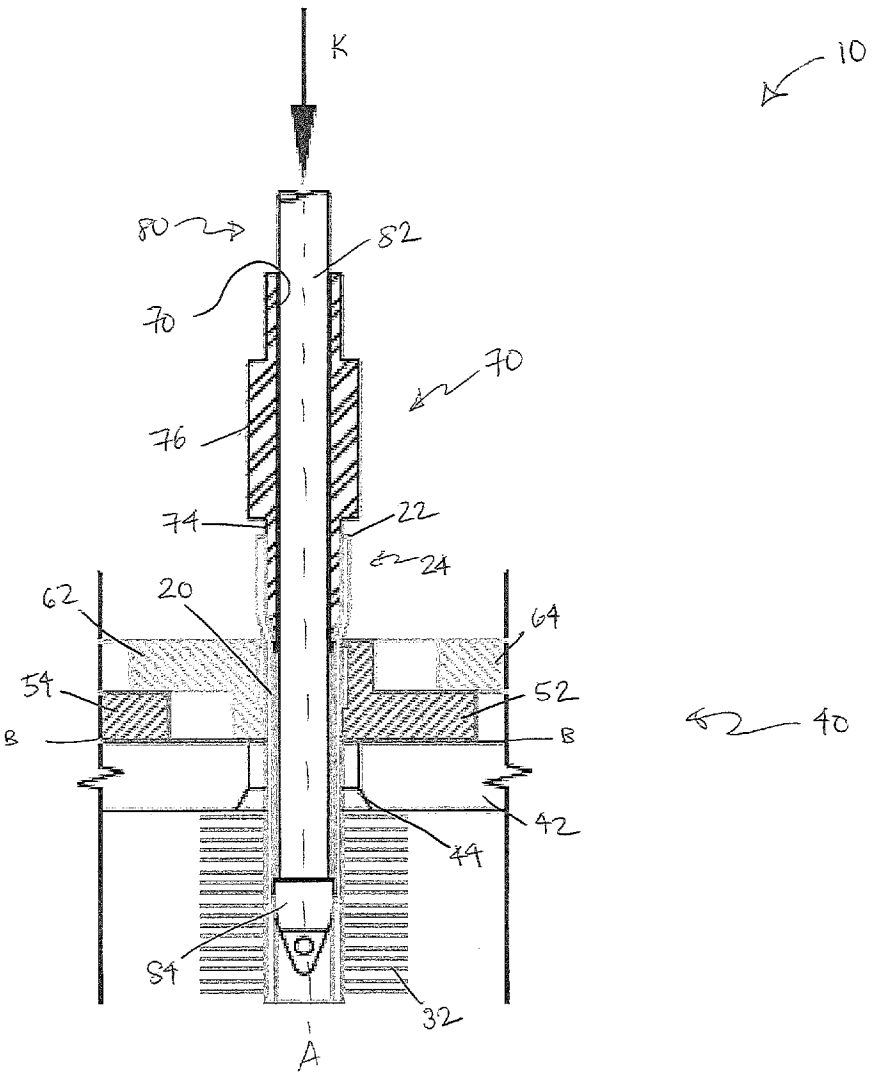
FIG. 7 is a cross-sectional view of a tube expanding apparatus according to an exemplary embodiment of the invention.
Figure 8:
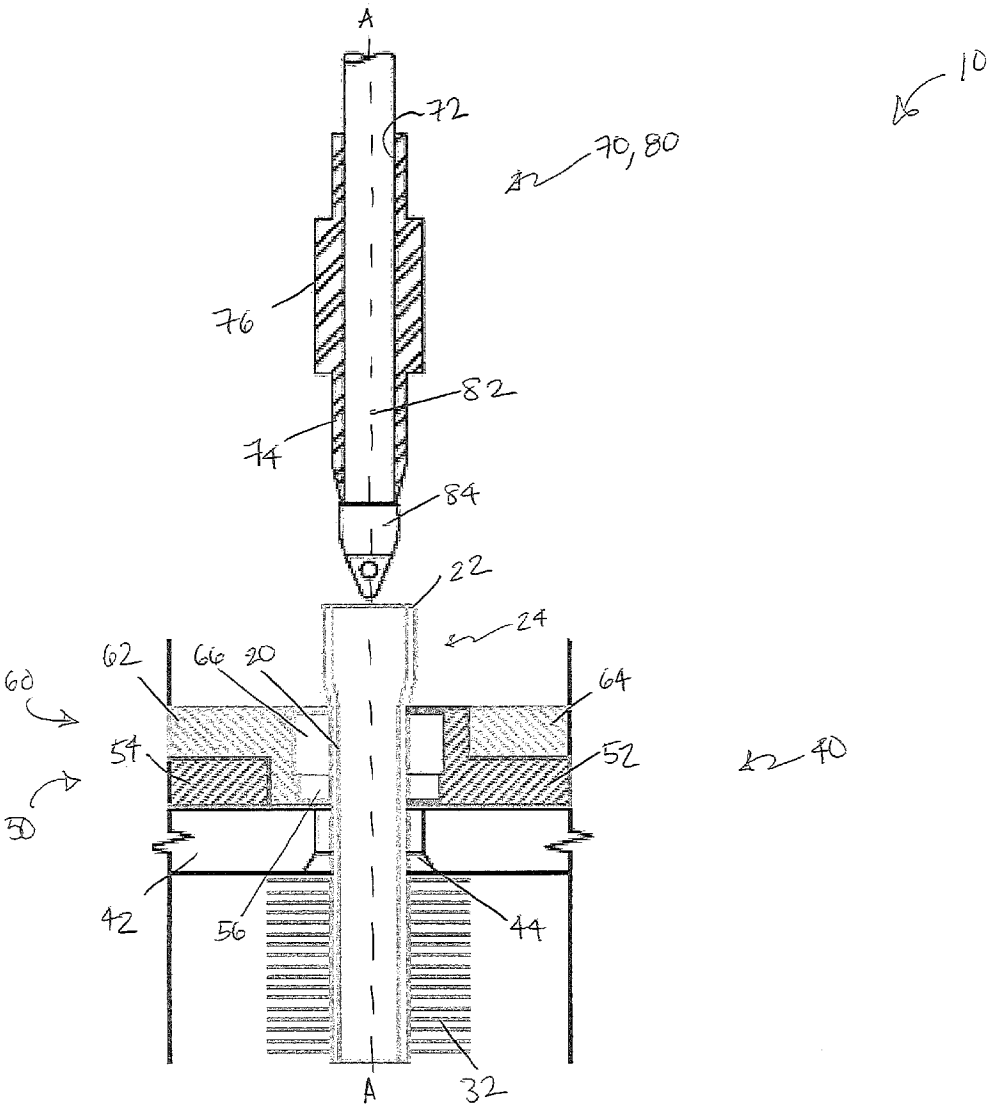
FIG. 8 is a cross-sectional view of a tube expanding apparatus according to an exemplary embodiment of the invention.
Figure 9:
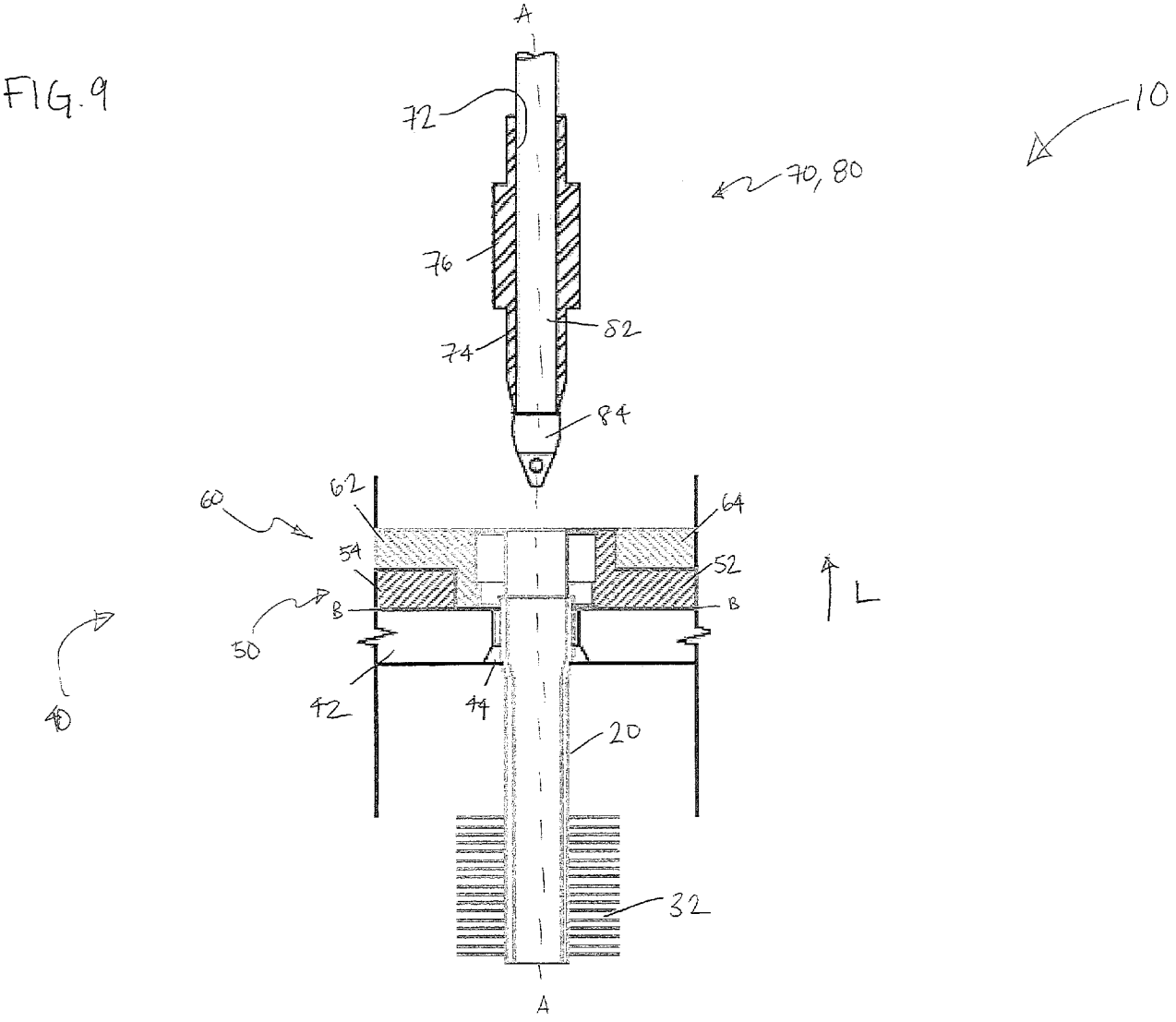
FIG. 9 is a cross-sectional view of a tube expanding apparatus according to an exemplary embodiment of the invention.

After the first portion 74 of the belling tool 70 is inserted into the open end 22 of the tube 20, the first grip 52 and the second grip 62 are moved a small distance along plane B in the direction of the first position, out of engagement with the surface of the tube 20 (FIG. 6). The first portion 74 of the belling tool 70 sufficiently secures the end 22 of the tube 20 as the remaining length of the tube 20 is expanded. By moving the first and second grip 52, 62 out of engagement with the surface of the tube 20, further movement of the expander tool 80 is no longer restricted by the stripper block assembly 40. The expander bullet 84 is advanced to the end of the U-shaped bend to expand the entire length of the tube 20 (FIG. 7). Referring now to FIGS. 8 and 9, after the length of the tube 20 has been expanded, the expander tool 80 and the belling tool 70 are retracted and removed from the belled, open end 22 of the tube 20. In addition, the first grip 52 and the second grip 62 are moved back to a first position, such that a gap exists between each grip 52, 62 and the tube 20. The belled open end 22 of the tube 20 is then slid through holes 56 and 66 and bore 44 to remove the stripper block assembly 40 in the direction indicated by arrow L from around the tube 20.

Expanding and belling a tube 20 using the tube expanding apparatus 10 and method described minimizes the variable that affects tube length and coil failure. Current compression expansion equipment and programming can be easily modified to create an efficient tension expansion apparatus 10. The scrap rates of failed tubes will be minimized, thereby reducing the costs associated with the tension expansion process.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. An apparatus for expanding and belling a tube in tension, comprising:

a receiver for supporting a first end of a tube;

a stripper block assembly for orienting a second end of the tube along an axis, the stripper block assembly including a first grip and a second grip movable in and out of engagement with a surface of the tube;

a movable belling tool axially aligned with the tube for belling a desired length of the tube and for supporting the second end of the tube; and an expander tool arranged to pass through the axially aligned tube to expand the tube, the expander tool including an expander rod connected to an expander bullet, wherein a portion of the expander bullet has a diameter larger than an inner diameter of the tube;

wherein the first grip and the second grip are movable between a first position and a second position, wherein movement of the expander tool within the tube is limited by the first grip and the second grip when the first grip and the second grip are in the second position and movement of the expander tool within the tube is not limited by the first grip and the second grip when the first grip and the second grip are in the first position;

wherein the expander rod has a length sufficient to travel the whole tube length, the expander bullet being advanced from the second end to the first end of the tube.

2. The apparatus according to claim 1, wherein the tube is a hairpin tube such that the first end of the tube is generally u-shaped.

3. The apparatus according to claim 1, wherein the receiver includes a pair of mating dies that encompass the first end of the tube.

4. The apparatus according to claim 1, wherein the belling tool is a generally hollow cylinder having a first portion with a first outer diameter and a second portion with a second, larger outer diameter.

5. The apparatus according to claim 4, wherein the belling tool creates a bell in the second end of the tube having a length equivalent to a length of the first portion.

6. The apparatus according to claim 4, wherein the first portion of the belling tool supports the second end of the tube.

7. The apparatus according to claim 4, wherein the rod of the expander tool slidably engages an interior surface of the hollow cylinder of the belling tool.

8. The apparatus according to claim 1, wherein:

the belling tool has a first portion for insertion into the tube and forming a bell;

wherein a distance between the first grip and the second grip in the first position is less than an outer diameter of the first portion.

* * * * *